US006489604B1

(12) United States Patent
Fardin et al.

(10) Patent No.: US 6,489,604 B1
(45) Date of Patent: Dec. 3, 2002

(54) HARNESS SYSTEM FOR IDENTIFICATION PURPOSES

(75) Inventors: Rahim Fardin, Dietikon; Peter Gerber, Berikon, both of (CH)

(73) Assignee: Oerlikon Contraves AG, Zurich (CH)

( * ) Notice: Subject to any disclaimer, the term of this patent is extended or adjusted under 35 U.S.C. 154(b) by 0 days.

(21) Appl. No.: 09/516,782

(22) Filed: Mar. 1, 2000

(30) Foreign Application Priority Data

Feb. 24, 2000 (CH) ..... 0362/00

(51) Int. Cl.[7] ..... H01J 40/14; F41G 3/26

(52) U.S. Cl. ..... 250/216; 250/214 R; 434/22

(58) Field of Search ..... 250/216, 221, 250/208.1, 208.2, 203.2, 227.24, 214 R; 434/11, 21, 22; 463/51, 52; 359/157

(56) References Cited

U.S. PATENT DOCUMENTS 5,742,251 A * 4/1998 Gerber ..... 342/45
5,788,500 A * 8/1998 Gerber ..... 250/208.1
5,954,538 A * 9/1999 Huang ..... 439/502

FOREIGN PATENT DOCUMENTS

| | | |
|---|---|---|
| DE | 40 03 960 | 8/1990 |
| EP | 0 270 048 | 6/1988 |
| EP | 0 836 069 | 4/1998 |

* cited by examiner

*Primary Examiner*—Kevin Pyo
(74) *Attorney, Agent, or Firm*—Browdy and Neimark

(57) ABSTRACT

The harness system for identification purposes has several harnesses (101, 111), which are provided with complementary parts (102, 112), which are connected with electrically conducting cables (105, 115), of connecting buttons in order to mechanically connect the harnesses with each other and simultaneously to provide electrical connections via the cables between detectors fastened on the harness system and other electronic components. The connecting buttons are preferably snap fasteners having respectively one head part (102) and one hollow part (112).

20 Claims, 5 Drawing Sheets

HARNESS SYSTEM FOR IDENTIFICATION PURPOSES

The present invention relates to a harness system for identification purposes, having at least two harnesses.

A harness system for combat purposes is known from EP 0 836 069 A1, having a plurality of elements, such as light detectors, a laser transmitter and a control unit. This system comprises several harnesses provided with electric components, which exchange information signals with a central unit by means of ultrasound or radio, and it is the object of the present invention to improve such a system.

This object is attained in an advantageous manner by a harness system in accordance with claim 1.

Further advantageous embodiments of the invention ensue from the further dependent claims.

Figure 1:
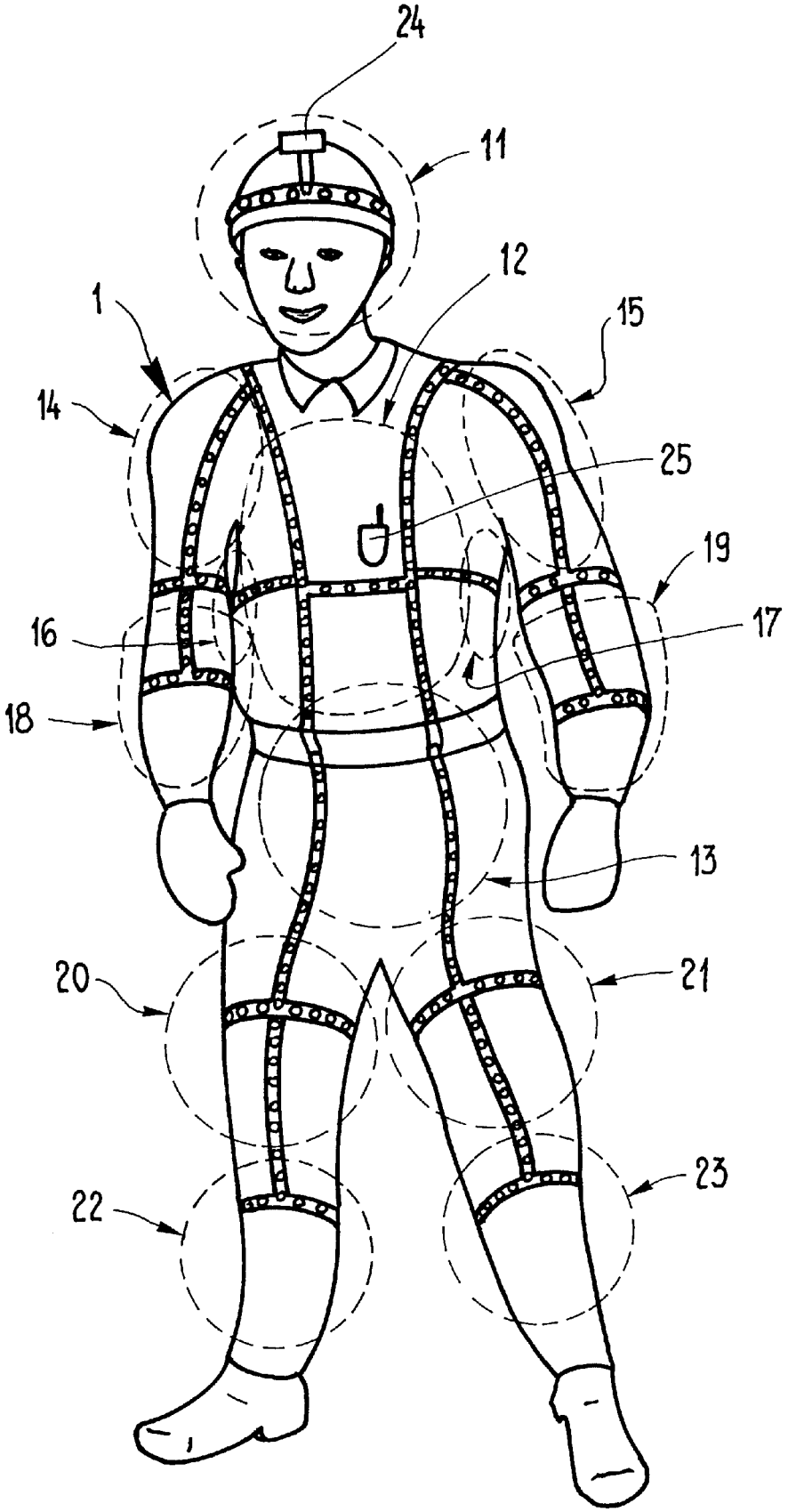
Figure 2:
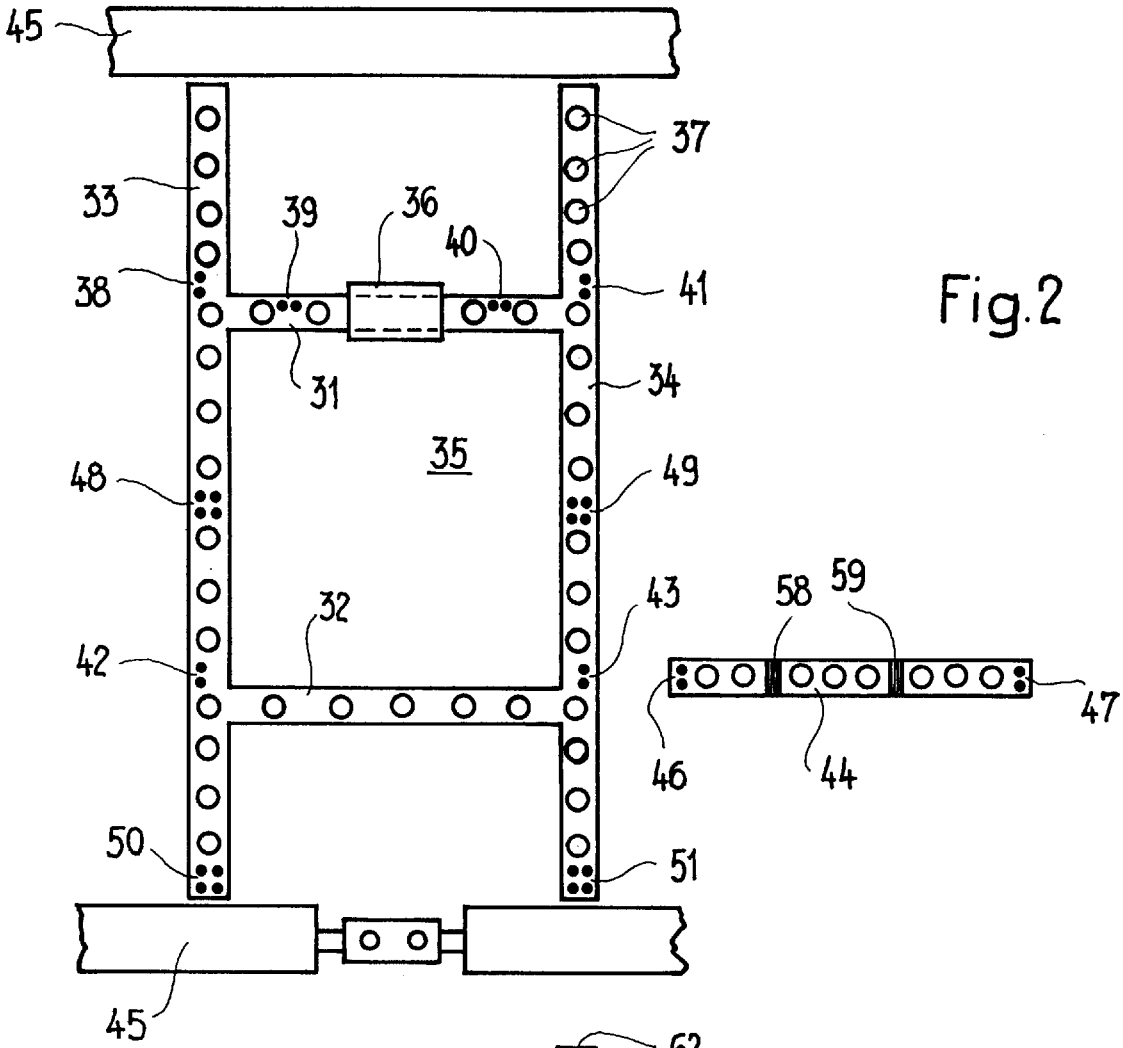
Figure 3:
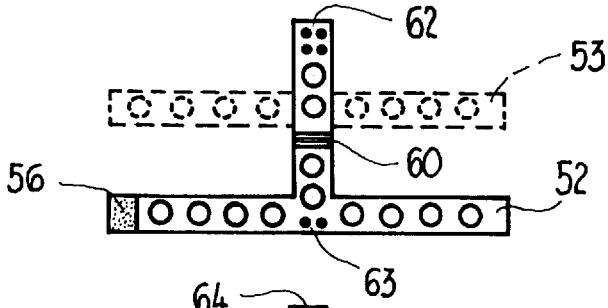
Figure 4:
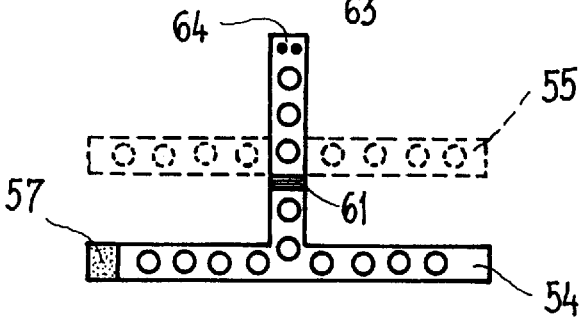
Figure 5:
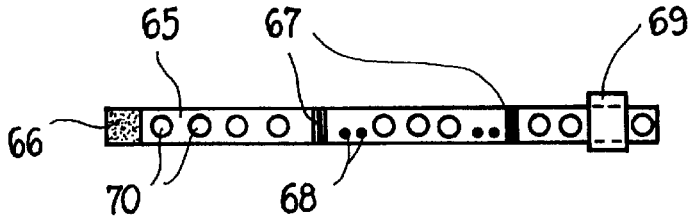
Figure 6:
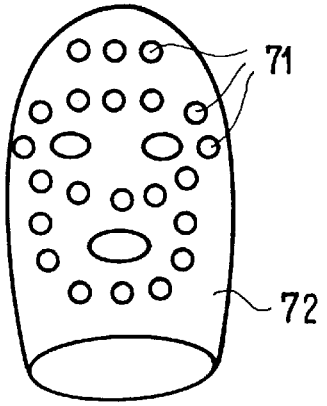
Figure 7:
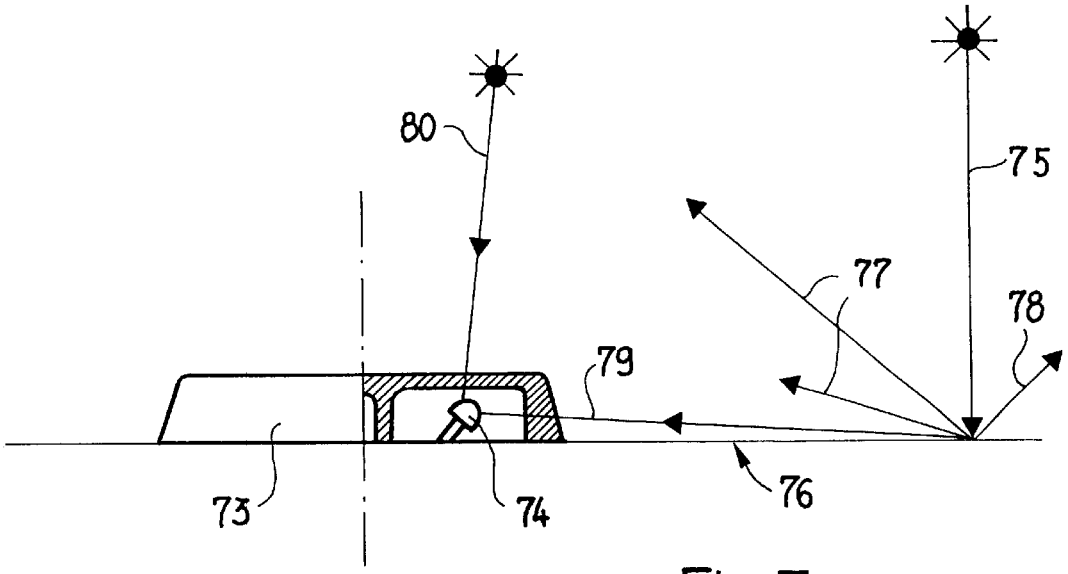
Figure 9:
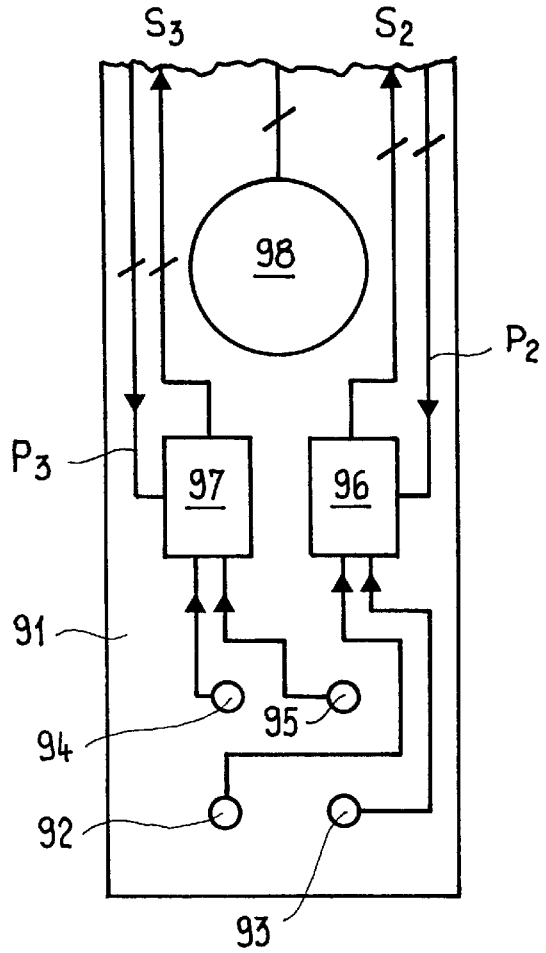
Figure 8:
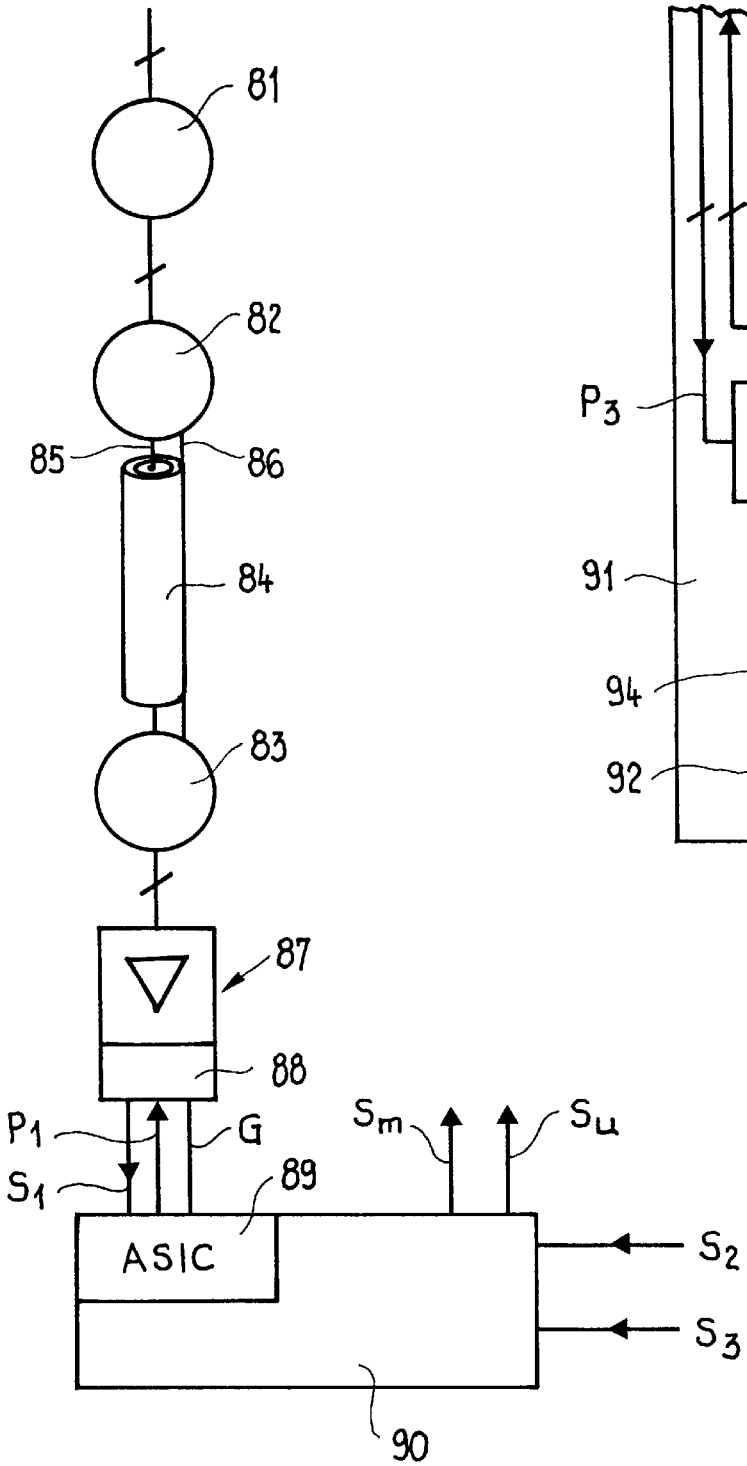
Figure 10:
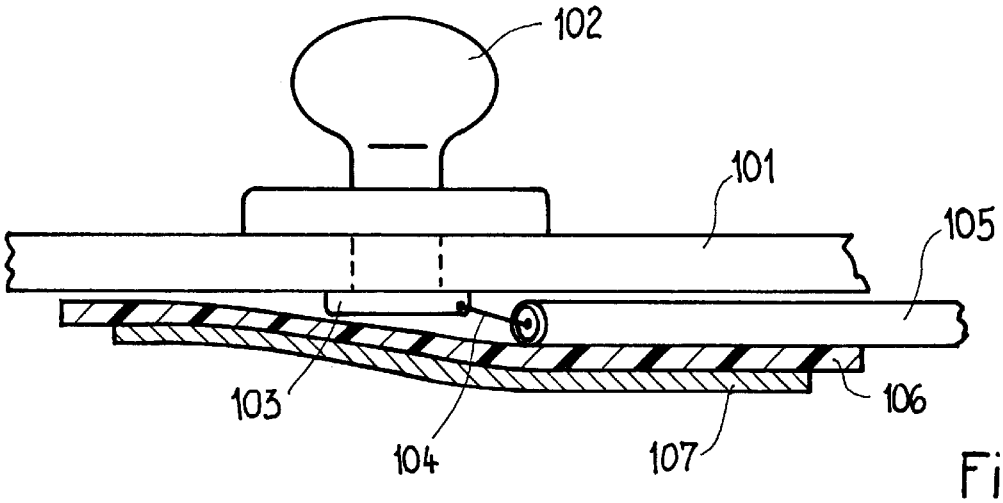

The invention will be explained in greater detail by way of example in what follows, making reference to the drawings. Shown are in:

FIG. 1, a schematic representation of a total harness system in accordance with the invention, FIGS. 2 to 4, various harness arrangements of such a harness system, FIG. 5, a schematic representation of a helmet harness for this harness system, FIG. 6, a simplified representation of a mask, FIG. 7, a sketch for explaining the functioning of the detectors of such a system, FIG. 8, several detectors, linked in accordance with the invention, FIG. 9, a schematic representation of snap fasteners and amplifiers connected therewith, and FIG. 10, or respectively 11, a snap fastener head, or respectively snap fastener cover, mounted on a harness.

The harness system in accordance with FIG. 1 comprises various harness arrangements, such as body harnesses, arm harnesses, leg harnesses and/or a head or helmet harness for a soldier. The human body 1 is divided into several regions for this purpose. Twelve visible regions 11, 12, 13, . . . 23 are represented in FIG. 1. However, up to sixteen regions are preferably used. These harness arrangements, which are releasably connected with each other by complementary connecting elements, preferably by snap fasteners, are equipped with light detectors, which provide electric signals to a central unit. Such a system can also comprise further harness arrangements, not represented in FIG. 1, as well as an electrical control unit, also called tracking unit or Sim-City. The system also comprises a transmitting/receiving unit or communications unit 25, also called master unit, which could possibly also be only a transmitter unit.

FIG. 2 shows a harness arrangement having not only harnesses designed in a strip-shape, but also one-piece branched harnesses. For example, two longitudinal harnesses 33, 34, which are permanently connected with transverse harnesses 31, 32 in corner sections, are represented in FIG. 2, which in this way form a large opening 35, through which a soldier can insert his head and neck. In this case, the longitudinal harnesses 33, 34 are shoulder harnesses, and the transverse harnesses a chest harness 32, or respectively a back harness 31. A small housing 36 for a central unit and/or for batteries is mounted in the transverse harness 31. A plurality of detectors 37 and groups of respectively two snap fasteners 38, 39, 40, 41, 42 and 43 are mounted on the longitudinal harnesses and transverse harnesses.

A loin harness 44 and an abdominal harness 45 are also represented in FIG. 2. The ends of the loin harness 44 can be connected with the aid of snap fasteners 46 and 47 with the snap fasteners 43, or respectively 42, of the longitudinal harnesses. The abdominal harness 45 can also have snap fasteners which permit it to be connected to the longitudinal harnesses. Such snap fasteners consist, for example, of a pressure part and a hollow part. These parts are also called head, or respectively cover. In accordance with the present invention, they are not only used for the mechanical fastening of the various harnesses, or respectively belts, to each other, but also for providing electrically conductive contacts for various signals, so that they are employed in pairs in accordance with the electric positive or negative poles. Groups of respectively four snap fasteners 48, 49, 50 and 51 are also arranged on the longitudinal harnesses and the transverse harnesses.

Without a loin harness 44, the harness arrangement in accordance with FIG. 2 represents the minimal equipment of a harness system for training purposes, so to speak. Thus, a harness system comprises at least two harness arrangements, or respectively at least two harnesses.

FIG. 3 shows a simple harness arrangement 52, consisting of an upper arm and a thigh harness, and an optional additional harness 53.

FIG. 4 shows a lower leg or forearm harness 54 and an optional additional harness 55. The harnesses in FIGS. 3 and 4 are respectively embodied to be T-shaped with a longitudinal harness and a transverse harness, which are provided with a so-called Velcro connector 56, or respectively 57. Some harnesses in FIGS. 2, 3 and 4 have at least one intermediate piece 58, 59, or respectively 60, 61, made of an elastic, or respectively stretchable material, for improved adaptation to the anatomical dimensions of the soldier. The harness in FIG. 3 has four upper snap fastener heads 62 and two lower snap fastener covers 63. In contrast to this, the harness in FIG. 4 only has two upper snap fastener heads 64.

The helmet or mask harness 65 represented in FIG. 5 has, for example, a Velcro connector 66, two stretchable intermediate pieces 67, two pairs of snap fasteners 68, an electronic unit 69 and a plurality of detectors 70. This harness can be used, for example, together with a mask 72 in accordance with FIG. 6 having a plurality of detectors 71.

FIG. 7 partially shows a detector 73 in section, which has four photodiodes 74, for example, only one of which is represented in the drawing. A laser shot 75 hitting the clothing 76 of the soldier, is reflected in all directions 77, 78, 79 on the surface of the clothing, so that a reflected, but weak, laser beam 79 reaches the photodiode 74 through the wall of the detector 73, which is transparent to this radiation, and which detects the radiation. Direct beams 80 can also be detected by the photodiode 74.

The photodiodes located in the detectors 81, 82, 83 in FIG. 8 are connected in parallel. The connection between the detectors, for example between the detectors 82 and 83, is preferably provided by means of cables 84, which have a central lead 85 and a conducting shielding 86. The last sensor 83 of a chain is preferably connected by means of such a cable with a miniaturized amplifier circuit 87, which can include a digital converter 88, for example a Schmitt trigger, or a simple comparator, for providing a defined output signal S1 to an ASIC (Application-Specific Integrated Circuit) 89 located, for example, in a small print plate 90, wherein P1 is the supply voltage and G the ground.

FIG. 9 shows an end 91 of a harness with four snap fastener heads and/or covers 92, 93, 94, 95, to which two miniaturized amplifier circuits 96, or respectively 97, have been connected in pairs. During operation, a signal, for example from the harness arrangement in FIG. 4. reaches the amplifier circuit 96, which is provided with power through a cable P2, via the direct connection between the snap fasteners 64 and 63 and via cables which, in the harness arrangement in FIG. 3, connect the snap fasteners 63 with two of the snap fasteners 62, and via the connection between the latter and the snap fasteners 92, 93 (FIG. 9). In this case a signal generated by the detectors of the harness arrangement in FIG. 3 reaches the amplifier circuit 97, which is provided with power through a cable P3, via the direct connection between the two other snap fasteners 62 and the snap fasteners 94, 95 connected with them. The amplified signals S2 and S3 from the amplifier circuits 96, or respectively 97, are fed to the ASIC of the print plate 90, or to another evaluating unit, for example.

FIG. 10 shows a snap fastener head 102 mounted on the outside of a harness 101, having a rivet 103 protruding from the inside of the harness 101, with which an end 104 of a cable 105 is electrically connected. With snap fasteners such as the pair 64 in FIG. 4, the one end of the cable 104 as the central lead is connected with the one snap fastener, and as the other end the sheathing of the cable 104 is connected with the other snap fastener. The rivet 103 is separated by an insulation 106 from the shielding 107, which can be a thin foil made of metal, aluminum, copper or a copper alloy.

Figure 11:
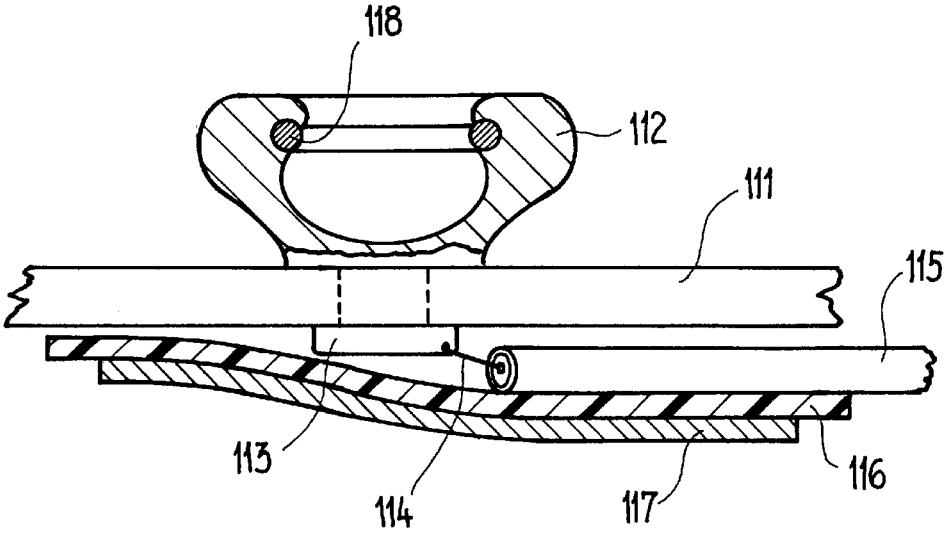

FIG. 11 shows a snap fastener cover 112, mounted on the outside of a harness 111 and having a rivet 113 projecting from the inside of the harness 111, with which one end 114 of a cable 115 is electrically connected. The rivet 113 is protected by an insulation 116 and is shielded by the shielding 117. The shieldings 107 and 117 are large enough so that they shield the area where several cooperating snap fasteners are located. The snap fastener cover 112 has a spring 118, which stabilizes the mechanical connection between the head and cover and at the same time assures an electrical contact.

The system of the invention in accordance with FIGS. 1 to 11 functions as follows:

All detectors of a defined region or zone, such as represented in FIG. 4 by way of example, are interconnected in such a way that a signal appears at the two snap fastener heads 64, even if only one of the detectors of the zone detects a laser beam. By means of this it can be determined whether a defined body zone of the soldier was hit by a laser beam. During operation, the snap fastener heads 64 are pressed into the snap fastener covers 63, or vice versa, so that the mentioned electrical signal reaches the central unit 90 or 36 through two of the snap fastener heads 62 and via two of the snap fastener covers 51. In this way signals from the various zones can be identified and evaluated in the central unit.

Corresponding information can be stored in the central unit or can be passed on from there to a central or command station, for example via radio. The shieldings 107 and 117 protect the circuit against the effects of electromagnetic waves, which could induce interference voltages.

In accordance with another embodiment of the invention, the information stored in the central unit can be transmitted electro-magnetically Sm (FIG. 8) or by means of ultrasound Su to the transmitting/receiving unit 25, and transmitted from there to the central or command station.

In accordance with another embodiment of the invention, each zone can have its own sub-unit, for example in the form of a chip, in such a way that, if all sub-units are connected to a common bus via the snap fasteners, protocolled signals from the sub-units reach the central unit and, if desired, via the latter the transmitting/receiving unit.

The ASIC is preferably constructed in such a way that it understands the following codes: combat-simlas, basic miles, standard miles PID (Player Identification Code) and enhanced miles PID.

The various elements used, which need not be visible like the detectors, are miniaturized and hidden in covers with which the harnesses are provided in order to protect these elements and/or to fasten them together with the harnesses. In actual use, only the battery housing will be visible.

A GPS (Global Positioning System) can be integrated into the transmitting/receiving unit.

In a further embodiment of the invention the amplifier circuits 87 can be designed in such a way that they can amplify very weak signals resulting from indirect laser beams 75 which are modulated with pulses, for which the amplifier circuits have a particularly high amplification factor, for example by means of a resonance effect.

Narrow laser beams (75) are preferably employed, which therefore can only touch a small area of the target object. This results in an improved accuracy of the impact point over the use of wider laser beams. To increase this accuracy, the harness system can have means for separately processing the signals from different detectors or groups of detectors, which detect a laser beam simultaneously, and one of the central units 90 or 36 can include a microprocessor or a microprocessor function for calculating the geometric center of the position of the various detectors or groups of detectors, or respectively sensors, from these signals, because it can be assumed that this center approximately coincides with the impact point of the narrow laser beam 75.

What is claimed is:

1. A harness system for identification purposes, having at least two harness elements, which have portions in which complementary connecting means are fixed in order to connect the harness elements mechanically with each other and simultaneously to make electrical connections between electronic components fastened on the harness elements by means of conductors, wherein the connecting means are snap fasteners with respectively one individual head and one individual cover, and wherein said harness system is configured to be worn by a human being.

2. The harness system in accordance with claim 1, wherein said head or said cover is mounted on the outside of a harness element and has a rivet protruding from the inside of said harness element, said rivet being electrically connected to an end of a conductor.

3. The harness system in accordance with claim 1, wherein at least one harness element is provided with at least a detector sensitive to laser radiation which is connected via installed electrical conductors to complementary parts of said fasteners mounted on said harness elements, in order to feed detector signals through these installed electrical conductors directly to an electronic unit, and wherein said electronic unit is mounted on one of said harness elements.

4. The harness system in accordance with claim 3, wherein said signals are fed from said detectors to said electronic unit via at least a cable having a central lead and a conductive sheathing which are the conductors feeding said signals.

5. The harness system in accordance with claim 3, wherein a central harness or a central harness arrangement having said electrical unit is connected by means of first snap fasteners to a first area of a first harness or first harness arrangement which in turn has a second area connected by means of second snap fasteners to a second harness or second harness arrangement, and wherein said harnesses or harness arrangements have installed electrical conductors in order to feed detector signals from said second harness or second harness arrangement via said first harness or first harness arrangement to the electrical unit.

6. The harness system in accordance with claim 3, wherein a part of said head has a convex surface of at least approximately spherical shape and a part of said or a cover has a complementary concave surface at least approximately spherical shape.

7. The harness system in accordance with claim 3, wherein at least some harness elements have at least one strip interrupted by an attached intermediate strip piece made of an elastic, or respectively stretchable material, for improved adaptation to the anatomical dimensions of said human being.

8. A harness system for identification purposes, having at least two harness elements, which have portions, in which are fixed complementary connecting means in order to connect the harness elements mechanically with each other and simultaneously to make connections between electronic components fastened on the harness elements by means of conductors, wherein said connecting means are snap fasteners with respectively one head element and one hollow element, said head element or said hollow element being mounted on the outside of a harness element and having a rivet protruding from the inside of said harness element, said rivet being electrically connected to an end of a conductor, wherein said harness system is configured to be worn by a human being after said complementary connecting means have been closed, wherein said harness system is provided with detectors sensitive to laser radiation which are connected via installed electrical conductors to complementary elements of these connecting means, in order to feed signals from these detectors through these installed electrical conductors directly to an electronic central unit, and wherein said electronic central unit is mounted on a central harness element or a central harness arrangement.

9. The harness system in accordance with claim 8, wherein a part of said head element has a convex surface of at least approximately spherical shape and a part of said or a hollow element has a complementary concave surface of at least approximately spherical shape.

10. The harness system in accordance with claim 8, wherein said signals are fed from said detectors to said electronic unit via at least a cable having a central lead and a conductive sheathing which are the conductors feeding said signals.

11. The harness system in accordance with claim 8, wherein said rivet is protected by an insulation and is shielded by a shielding being large enough so that they protect the area where at least two cooperating snap fasteners are located.

12. The harness system in accordance with claim 8, wherein said snap fastener hollow element has a spring, which stabilizes the mechanical connection between the head element and the hollow element and at the same time assures an electrical contact.

13. The harness system in accordance with claim 8, wherein said electrical conductors are realized as shielded cables or wires or flexible cords, or in the form of shielded busses.

14. The harness system in accordance with claim 8, wherein said detectors are distributed on predetermined areas corresponding to defined zones of the human body and are interconnected in such a way that a signal appears at two snap fastener elements, even if only one of the detectors of the zone detects a laser beam.

15. The harness system in accordance with claim 9, wherein said detectors have a housing with at least one part which is transparent to laser radiation, and comprise at least two photodiodes, which are sensitive to this radiation.

16. The harness system in accordance with claim 9, wherein at least some harness elements have at least one strip interrupted by an attached intermediate strip piece made of an elastic, or respectively stretchable material, for improved adaptation to the anatomical dimensions of said human being.

17. The harness system in accordance with claim 8, wherein means are provided for separately processing signals from different detectors or groups of detectors, which simultaneously detect a laser beam, and wherein said central unit includes a microprocessor or a microprocessor function in order to calculate the geometric center of the position of the various detectors or groups of detectors from these signals.

18. The harness system in accordance with claims 17, wherein amplifier circuits are provided which have a particularly high amplification factor for electrical signals resulting from indirect laser beams, and wherein this high amplification factor results from a resonance effect of the amplifier circuits in connection with an optical modulation of the laser radiation.

19. The harness system in accordance with claims 8, wherein said connecting means have an individual head element or an individual hollow element, wherein at least some of said harness elements are designed in a strip-shape, and wherein said rivet is protected by an insulation.

20. The harness system in accordance with claim 19, wherein said harness system includes a helmet or mask harness having at least one detector.

* * * * *